United States Patent [19]

Lado

[11] 4,231,698

[45] Nov. 4, 1980

[54] SYSTEM FOR ONE-HAND CONTROL OF TWO WINCHES DURING HOISTING OF CLOSED CLAMSHELL, WITH DIFFERENTIATION

[75] Inventor: William J. Lado, Rome, N.Y.

[73] Assignee: Pettibone Corporation, Chicago, Ill.

[21] Appl. No.: 867,704

[22] Filed: Jan. 9, 1978

[51] Int. Cl.[3] ..... B66D 1/26

[52] U.S. Cl. ..... 414/624; 60/484; 37/183 R; 254/315

[58] Field of Search ..... 214/656; 254/184, 150 FH; 294/112; 37/182–188; 60/424, 484; 212/42, 44; 414/624, 625

[56] References Cited

U.S. PATENT DOCUMENTS

| | | | |
|---|---|---|---|
| 3,033,399 | 5/1962 | Conner et al. | 214/656 |
| 3,578,787 | 5/1971 | Brickett et al. | 212/44 X |
| 3,776,513 | 12/1973 | Mosley | 254/150 FH |
| 4,088,304 | 5/1978 | Gradert | 254/184 |

FOREIGN PATENT DOCUMENTS

| | | | |
|---|---|---|---|
| 1169086 | 9/1958 | France | 37/183 R |

*Primary Examiner*—L. J. Paperner

*Attorney, Agent, or Firm*—Louis Robertson

[57] ABSTRACT

The invention relates to cranes or the like in which two hoist lines control a clamshell bucket. If the winch for one line is operated to draw in this line, it closes the clamshell bucket and hoists it. During this hoisting, the winch for the other line must also be operated to pull in the slack. If this other line is reeled in excessively, it will dump the bucket. A system is provided for automatic control of the winch being used for slack-takeup, thus avoiding the need for great care and delicate finesse by an experienced hand on a second control lever. The system puts the slack-takeup winch in hydraulic series or tandem with the discharge from the hoisting winch, but limits the hydraulic pressure supplied to the slack-takeup winch so that it is barely enough to accomplish the takeup of its line, and cannot cause dumping.

6 Claims, 4 Drawing Figures

SYSTEM FOR ONE-HAND CONTROL OF TWO WINCHES DURING HOISTING OF CLOSED CLAMSHELL, WITH DIFFERENTIATION

INTRODUCTION

The invention of which this disclosure is offered for public dissemination in the event that adequate patent protection is available relates to simplified means for controlling a clamshell bucket.

Clamshell buckets are conventionally controlled by two hoist lines, each with its own winch. Ordinarily each winch is separately controlled by a conventional reversing valve, each valve having a separate handle. The operator normally will keep one hand on each of the handles. To open the clamshell bucket the operator will draw back on one handle, causing the winch controlled by it to raise the selected one of the two hoist lines which, through the conventional construction of the clamshell bucket assembly, will cause the bucket to be opened as it is raised. If the operator draws back on the other handle, it operates the other winch to raise its line which, through the conventional clamshell assembly construction, will cause the clamshell to close as it is raised. With conventional apparatus, when the operator is raising the closed clamshell, by one line, controlling this operation by one hand, it is necessary for him to operate the other control handle judiciously to draw in the slack of the other line. He must do so without drawing in more of this other line than is required for removing its slack because if it is drawn too much, it will begin to dump the bucket.

According to the present invention, while one line is being hoisted to raise the closed clamshell bucket, fluid is supplied automatically to the winch for the other line with its pressure automatically limited to a very low value appropriate for drawing in the slack of the line without having the lifting force necessary to dump the bucket. One advantageous way of accomplishing this utilizes the hydraulic fluid discharged from the winch motor being used for hoisting, by placing the two winch motors in hydraulic series. During much of the hoisting operation, this will automatically feed to the second winch motor the proper quantity of oil. However, at the start of each closing- and-hoisting operation, and possibly at some other times, a lag between the two line pulls is needed. This is achieved by preventing the pressure of hydraulic fluid directed to the second winch from building up to a value which would operate that winch with enough force to do more than pull in slack. A valving system is provided for diverting the oil to the hydraulic reservoir whenever a predetermined pressure limit is reached. The main diverting valve can conveniently be a pilot actuated valve, of a type capable of smoothly modulating the flow through it to maintain a given pilot pressure.

Additional advantages of the invention will be apparent from the following description and from the drawings.

DESIGNATION OF FIGURES

INTENT CLAUSE

Although the following disclosure offered for public dissemination is detailed to ensure adequacy and aid understanding, this is not intended to prejudice that purpose of a patent which is to cover each new inventive concept therein no matter how others may later disguise it by variations in form or additions or further improvements. The claims at the end hereof are intended as the chief aid toward this purpose, as it is these that meet the requirement of pointing out the parts, improvements, or combinations in which the inventive concepts are found.

BACKGROUND DESCRIPTION

Figure 1:
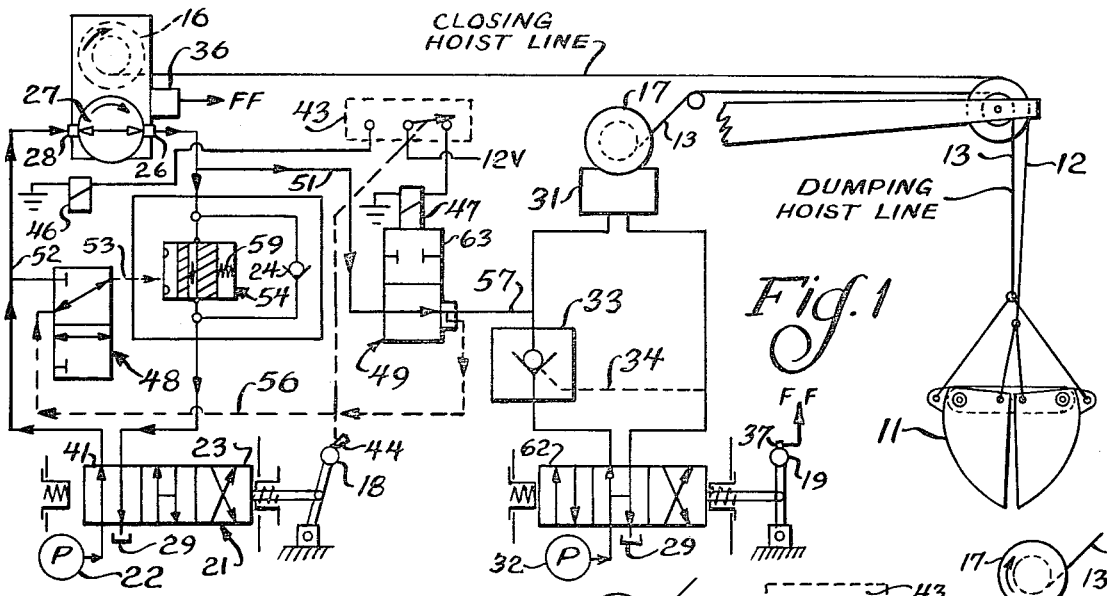
FIG. 1 illustrates diagrammatically a clamshell bucket controlled by two hoist lines extending down from a boom, together with a hydraulic circuit diagram for controlling the hoist lines as the clamshell bucket is being closed.

FIG. 1 illustrates a conventional clamshell bucket 11 controlled by two hoist lines 12 and 13. As is conventional practice, if the clamshell bucket is lifted or supported entirely by line 12, this will close the clamshell bucket; while if the lifting or support is entirely by line 13, this will open the clamshell bucket. Also according to conventional practice, lines 12 and 13 are drawn in by separate winches, respectively 16 and 17. These winches may be operated in conventional manner by manual manipulation of control handles 18 and 19.

OPENING. To open the clamshell so as to dump its load, or to prepare to seize a load, either of two basic and simple operations may be used. One is to raise line 13 while line 12 remains unmoving. The other is to let out line 12, while line 13 remains unmoving. Also, a skilled operator may raise line 13 while lowering line 12, thus releasing the load gently.

Figure 4:
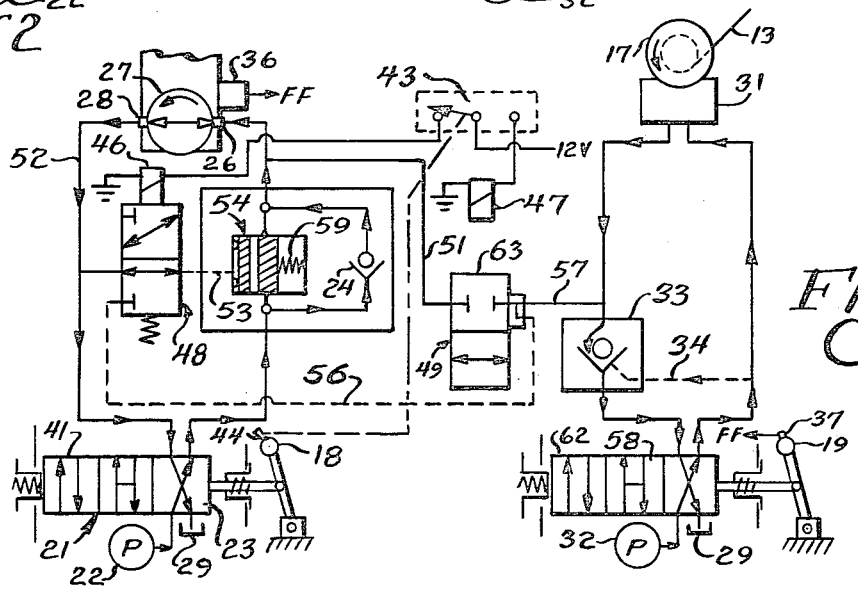
FIG. 4 illustrates the two winches being operated in the conventional manner, without any cross connection, as will be the practice in lowering the clamshell bucket when the present invention is provided.

LOWERING. By conventional practice, when the operator pushes both handles away from him as illustrated in FIG. 4, both winches pay out their hoist lines and the clamshell bucket is lowered. Thus, in FIG. 4, the valve spool (represented diagrammatically as 21) has been thrust to its pay-out position and hydraulic fluid flows from pump 22 through the control valve with its connections indicated in the cross flow portion 23, through the check valve 24 (not conventional) to the downport 26 of the winch motor 27; and from its other port 28 back through control valve as represented at 23 to the return line leading to reservoir 29. (The check valve 24 and associated items would not be present in a conventional circuit, their purpose being described later).

Similarly, winch motor 31 is operated by pump 32 in a circuit which is generally similar except for the provision of a pilot-actuated safety valve 33 in the line discharging from winch motor 31, as shown. This valve 33, as a matter of safety, prevents flow in the direction shown (for paying out the line) except when positive pressure is provided to its pilot port by pilot line 34.

If the clamshell to be lowered is an open clamshell being lowered to seize a load, it is desirable to be completely certain that line 12 is payed out fast enough not to cause closing of the clamshell as it is lowered to seize a load. To this end, one conventional practice is to use for winch 16 a winch motor 27 equipped with a free-fall solenoid 36, controlled by a button 37 on handle 19. This permits the winch 16 to be rotated faster by the pull of line 12 than it would be driven by winch motor 27, with a light enough drag so that there is no danger that it would cause closing of the clamshell 11. The operator therefore might choose not to operate the handle 18 during lowering of the bucket, but merely push buttom 37 and control the lowering by handle 19, all with one hand.

CLOSING. For closing the clamshell, after it has been lowered into the material to be picked up, the winch 16 is operated to draw in its line 12, while winch 17 remains inactive. Conventionally this is accomplished by the handle positions shown in FIG. 1. Handle 18 is drawn back to provide the connections represented by the left spool showing 41 to drive the winch motor 27 in the raising direction, and handle 19 is left alone, leaving its spool in the neutral position. The lifting action of line 12 closes the clamshell as it begins to lift it. The FIG. 2 flow diagram is not conventional, however.

Figure 3:
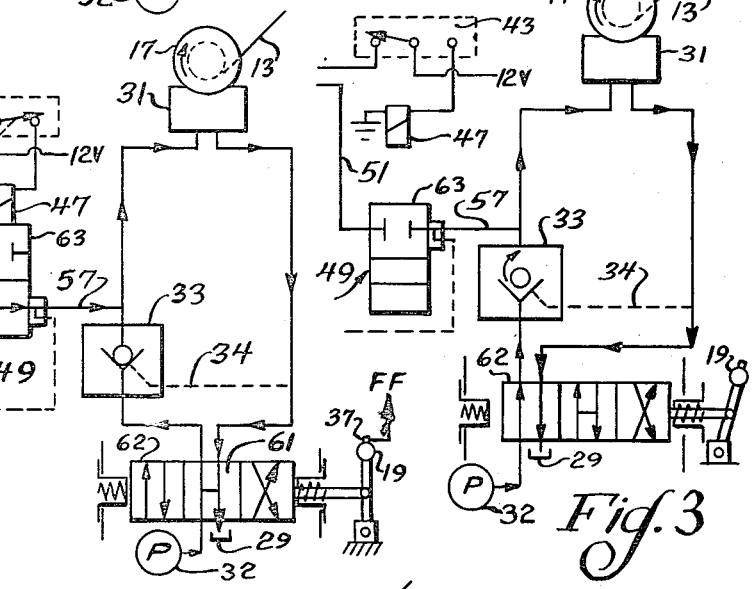
FIG. 3 illustrates the control of the right-hand winch for drawing in the dumping hoist line for dumping the clamshell bucket.

LIFTING. Continuation of this same lifting action will of course lift the closed clamshell. But as the clamshell rises, line 13 must now also be drawn in so that it will not develop dangerous excessive slackness. Conventionally, the operator must now draw back handle 19 to operate winch motor 31 in the raising direction much as seen in FIG. 3—but the winch speed must be just right. It must be fast enough to keep out excessive slack, but no faster than this requires or it will, when there is no more slack, start dumping the bucket. The finesse of a highly experienced operator and constantly alert operator is needed.

DESCRIPTION OF THE PRESENT INVENTION

Figure 2:
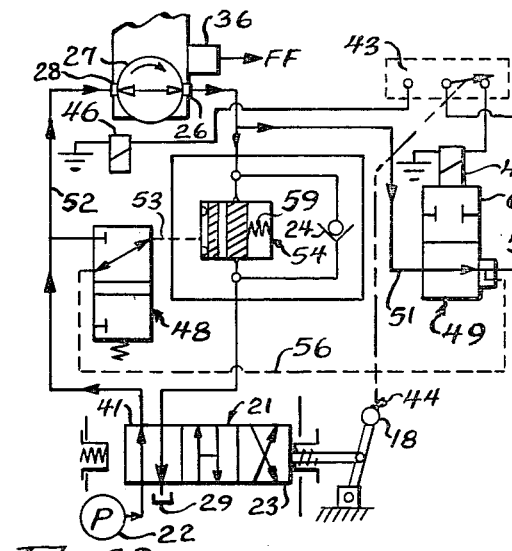
FIG. 2 illustrates the same hydraulic circuitry with the same manual valve control positions as in FIG. 1, but with low pressure hydraulic fluid flowing through the right-hand winch to maintain the relatively idle dumping hoist line taut, that is, free from slack.

This delicate finesse is made unnecessary by the present invention. When a relatively inexperienced operator draws handle 18 toward him to close and raise the clamshell by operating winch motor 27, the other winch motor is controlled automatically to remain idle at first and thereafter to move just the right amount for maintaining the dump cable 13 free from slack without any danger that it will start dumping the clamshell. FIGS. 1 and 2 show the means chosen for illustration of a way to accomplish this result according to the present invention. In this form of the invention, a toggle switch 43, which is preferably mounted in control handle 18 or controlled by a lever 44 on that handle, can convert the hydraulic circuitry to provide the automatic control feature of this invention or to lock it out. In FIG. 4 the toggle switch is shown making its left-hand connection, which locks out the automatic control of this invention. In FIGS. 1 and 2, the toggle switch 43 is shown in its right-hand position which makes available the automatic control of this invention.

In its left-hand position toggle switch 43 energizes solenoid 46. In its right-hand position it energizes solenoid 47. Solenoid 46 is part of a solenoid valve represented by 48, and solenoid 47 is part of a solenoid valve represented by 49. In FIG. 4 it is seen that the solenoid 47 is deenergized, blocking the line 51 which we will see later is a tandem flow line. Valve 46 is shown energized in FIG. 4 and therefore completing a connection from line 52, which may be called the up line for winch motor 27, directly to the pilot line 53 for pilot actuated valve 54. Thus when, in FIG. 4, the handle 18 is thrown to the opposite position making the connections represented by section 41 of the valving diagram, hydraulic pressure is applied not only to the winch motor 27 but also to the pilot line of valve 54 so that the latter is operated to let the hydraulic fluid discharged from motor 27 return to reservoir 29.

If the operator flips lever 44 to make the automatic control of this invention available, this shifts toggle switch 43 to the right-hand position shown in FIGS. 1 and 2 thereby deenergizing solenoid 46 so that pilot line 53 is no longer connected to line 52 as in FIG. 4, but instead is connected to automatic-control pilot line 56.

The same right-hand position of toggle switch 43 energizes solenoid 47, shifting its valve 49 so that tandem line 51 is no longer blocked, as was seen in FIG. 4, but is connected to tandem extension line 57.

TANDEM OPERATION

FIG. 2 illustrates tandem operation of the winch motors 16 and 17. As illustrated, the same hydraulic fluid which flows through motor 16 flows from it through hydraulic motor 17 so that they will be driven at the same speed. This of course assumes that they are designed to have the same speed when the oil flows through them are equal; and they should be so designed. When they rotate at the same speeds, they will tend to draw in lines 12 and 13 equally, so that no slack will develop in line 13. The hydraulic circuit for this tandem flow may be traced from pump 22 through valve section 41 through hydraulic motor 16 through tandem line 51, through the lower section illustration of valve 49, through extension tandem line 57, through winch motor 31, and through the neutral section 58 of the valve the spool of which is actuated by handle 19, and finally to reservoir 29. From extension pilot line 57, the hydraulic fluid cannot flow through check valve 33 because there is insufficient pressure in its pilot line 34 to open this valve.

TANDEM DRIVE BY-PASS

When the handle 18 is first operated to the position shown in FIG. 1 for closing the clamshell and hoisting it, the winch motor 31 must initially remain inactive while the winch motor 27 draws in line 12 to close the clam. This is accomplished by a pressure-responsive by-pass system. During the closing of the clam, a substantial part of the weight of the clamshell is still being carried by line 13. Accordingly, its winch motor 31 cannot be operated by low pressure oil, and if oil is fed to it through the tandem lines 51 and 57, a back pressure of oil will develop in the effort to try to move the winch motor 31. This back pressure is transferred into automatic control pilot line 56, through the upper-shown section of valve 48, to the pilot line 53 so that it operates valve 54. When valve 54 is fully operated, hydraulic fluid flows through it freely, or nearly so, so that the fluid which has operated winch motor 27 flows through this valve and through section 41 of valve 21 to reservoir 29. In other words, valve 54 now functions as a by-pass relative to tandem lines 51 and 57 so that their hydraulic fluid can return to the reservoir without driving winch motor 31. This is the approximate situation illustrated in FIG. 1. Valve 54 is there shown only partially open, on the assumption that this is enough to avoid excessive back pressure in tandem lines 51 and 57.

When the drawing in of line 12 has fully closed the clamshell, a slight continuation of the drawing in of line 12 will cause it to take the full load of the clamshell 11, relieving line 13 from this load. Continuing to draw in line 12 would cause slack to develop in line 13 if it were not drawn in also. However, the release of tension from line 13 enables its winch motor 31 to be turned by the hydraulic fluid available from tandem lines 51 and 57 without building up the high back pressure which resulted when line 13 was carrying a large part of the weight of clamshell 11. Hence, as soon as winch motor 31 can operate easily, the back pressure in tandem line 51 drops to a very low level. This reduction of the back pressure is reflected by a similar reduction in the pressure delivered by automatic control pilot line 56 to the pilot line 53 leading to valve 54. The spring in this valve, represented at 59, is therefore able to overcome this reduced pilot pressure and the valve 54 so that all of the hydraulic fluid which thereafter passes through winch motor 17 must also pass through winch motor 31.

If for any reason winch motor 31 should drive its winch 17 a little too fast so that its line 13 begins to take over the weight of clamshell 11, winch motor 31 will no longer be driven as easily as when line 13 carried no load, and hence the back pressure will build up in tandem lines 51 and 57. This increased back pressure will be transmitted through line 56 to pilot line 53 where it will begin to overcome the spring 59 of valve 54 so that this valve will crack open and let a little hydraulic fluid pass through it from the discharging side of winch motor 27. Usually a very small amount of valve fluid passing through valve 54 in this manner will be enough to relieve the build up of back pressure in tandem line 51, and hence relieve the back pressure transmitted to pilot line 53, and accordingly the valve 59 will again close valve 54. This description may be somewhat oversimplified in that if the winch 17 has a tendency to draw in its line 13 too fast so that that line begins to take up part of the weight of clamshell 11, the valve 54 may not open and close as described but may reach a stable condition at which it by-passes just enough oil constantly during this operation to keep the back pressure such that line 13 is merely drawn up to a slight tension. Whether valve 54 opens and closes or finds a stable condition may make no difference, the important point being to prevent line 13 from being drawn in excessively so that it has a sufficient tension to start the dumping of clamshell 11.

If the operator desires to stop the hoisting of the clamshell, he may move handle 18 to its neutral position, in which case the pressure oil from pump 22 will be returned immediately to reservoir 29 by the neutral section 61 of valve 21. Hence there will be no flow of pressure fluid through winch motors 27 and 31 to operate them, and the clamshell 11 will remain stationary. If the operator wishes to dump the clamshell, he can do so either by touching the button 37 to operate the free fall solenoid 36 and release line 12 so that this now-static line 13 dumps clamshell 11, or he can operate handle 18 to the opposite or lowering position so that motor 27 drives the winch 16 in a direction to release its line 12 allowing the now-static line 13 to dump the clamshell.

The operator may also, if he chooses, flip the lever 44 so as to shift the toggle switch 43 from its right-hand position shown in FIGS. 1 and 2 to its left-hand position shown in FIGS. 3 and 4. He will then be able to operate the handle 19 to dump the clamshell bucket. Thus, as seen in FIG. 3, when the handle 19 is drawn back to provide the connections shown by section 62, pressure from pump 32 is delivered through check valve 33 (which for this direction of flow does not need pressure in pilot line 34 in order to be opened) to the winch motor 31. Diversion of this by flow backwards through the tandem lines 57 and 51 and valve 54 is now blocked as indicated at the upper section 63 of valve 49.

HYDRAULIC DETAILS

Although the foregoing description would enable experts to choose suitable components, it may be helpful to mention some of the parts which have been found to be satisfactory.

For winch 16 with its free-fall solenoid 36, a winch assembly of Braden Manufacturing Company has been used. The winch 17 used is of a different type not permitting free fall.

Valve 54 together with check valve 24 are found in valve assembly 1E21-P8-30S88 of Fluid Controls Inc. The illustration here is only diagrammatic, but departs from conventional symbols to suggest its ability to modulate the rate of flow through it to maintain a predetermined back-pressure. This requirement may be sufficiently satisfied by maintaining the back pressure in a predetermined narrow range.

ACHIEVEMENT

From the foregoing it is seen that merely by adding some relatively inexpensive valves to a conventional hydraulic system, the need for delicate finesse by the operator during closing a clamshell and raising it is overcome. There will be fewer instances of damage to the hoist lines by allowing excess slack to develop in the dumping line, and fewer instances when, with danger to anyone beneath the bucket, the clamshell is inadvertently partially opened allowing more or less dumping of its contents. Although there may be various ways of accomplishing this result, it is perhaps essential to have means available at will for (1) supplying fluid to the slack-line winch motor during hoisting of the closed clamshell by the other winch motor, such supply being at least enough in volume to avoid excessive slack, and (2) means for limiting the pressure of fluid thus supplied to a value too low to start dumping the clamshell if the volume available is more than enough to exclude the slack.

I claim:

1. A hydraulic system for controlling a clamshell bucket by two hoist lines of which a first can close and raise the clamshell and the second can dump the clamshell if raised relatively to the first, said system including a first hydraulic motor and winch for the first hoist line and a second hydraulic motor and winch for the second hoist line, and means operable at will, when the first winch motor is operated to draw in the first hoist line, for supplying to the second winch motor a sufficient supply of hydraulic fluid to operate said second winch motor enough to avoid the development of excessive slack in the second hoist line, and means effective throughout raising the clamshell for controlling the pressure of said supply to provide a pressure sufficient to draw in the second hoist line, when slack; said system including means responsive to the back pressure of the fluid supplied to the second motor for limiting that pressure to a value too low to start dumping the clamshell.

2. A hydraulic system for controlling a clamshell bucket by two hoist lines of which a first can close and raise the clamshell and the second can dump the clamshell if raised relatively to the first, said system including a first hydraulic motor and winch for the first hoist line and a second hydraulic motor and winch for the second hoist line, and means operable at will, when the first winch motor is operated to draw in the first hoist line, for establishing connections placing the second motor hydraulically in series with the first motor, thereby tending to draw in the second hoist line at substantially the same speed as the first, and means effective throughout raising the clamshell for controlling the pressure of the hydraulic fluid thus supplied to the second motor to provide a pressure sufficient to draw in the second hoist line when slack; said system including means responsive to the back pressure of the fluid supplied to the second motor for limiting that pressure to a value too low to start dumping the clamshell.

3. A hydraulic system for controlling a clamshell bucket by two hoist lines of which a first can close and raise the clamshell and the second can dump the clamshell if raised relatively to the first, said system including a first hydraulic motor and winch for the first hoist line and a second hydraulic motor and winch for the second hoist line, and means operable at will, when the first winch motor is operated to draw in the first hoist line, for establishing connections placing the second motor hydraulically in series with the first motor, thereby tending to draw in the second hoist line at substantially the same speed as the first, and means effective throughout raising the clamshell for controlling the pressure of the hydraulic fluid thus supplied to the second motor to provide a pressure range sufficient to draw in the second hoist line when slack but limited to a pressure too low to start dumping the clamshell;

said last named means including a bypass past the second motor, and means for closing said bypass when the back pressure in the fluid being supplied to the second motor is below the stated pressure range, while opening it if that range is exceeded.

4. A hydraulic system for controlling a clamshell bucket by two hoist lines of which a first can close and raise the clamshell and the second can dump the clamshell if raised relatively to the first, said system including a first hydraulic motor and winch for the first hoist line and a second hydraulic motor and winch for the second hoist line, and means operable at will, when the first winch motor is operated to draw in the first hoist line, for supplying to the second winch motor a sufficient supply of hydraulic fluid to operate said second winch motor enough to avoid the development of excessive slack in the second hoist line, and means effective throughout raising the clamshell for controlling the pressure of said supply to provide a pressure sufficient to draw in the second hoist line, when slack, but limited to a pressure too low to start dumping the clamshell;

said system including solenoid valve means, and means on an operator's main control lever for him to selectively operate said solenoid valve means for either providing the system as defined or, at will, a system in which each of two operators' handles separately controls one of the motors.

5. A hydraulic system for controlling a clamshell bucket by two hoist lines of which a first can close and raise the clamshell and the second can dump the clamshell if raised relatively to the first, said system including a first hydraulic motor and winch for the first hoist line and a second hydraulic motor and winch for the second hoist line, and means operable at will, when the first winch motor is operated to draw in the first hoist line, for supplying to the second winch motor a sufficient supply of hydraulic fluid to operate said second winch motor enough to avoid the development of excessive slack in the second hoist line, and means for controlling the pressure of said supply to provide a pressure sufficient to draw in the second hoist line, when slack, but too low to start dumping the clamshell;

said system including solenoid valve means, and means on an operator's main control lever for him to selectively operate said solenoid valve means for either providing the system as defined or, at will, a system in which each of two operators' handles separately controls one of the motors;

and a pilot actuated valve controlling a return connection between the discharge side of the first motor, when drawing in its hoist line, and the reservoir; a tandem control valve controlling a connection from said discharge side to the input side of the second motor, and when open supplying fluid for driving the second motor to draw in its hoist line, and a valve controlled in correlation with the last named valve for connecting the pilot port of said pilot actuated valve to be responsive to the input pressure of the first motor when the tandem control valve is closed and to be responsive to the input pressure of the second motor when the tandem control valve is open.

6. A hydraulic system for controlling a clamshell bucket by two hoist lines of which a first can close and raise the clamshell and the second can dump the clamshell if raised relatively to the first, said system including a first hydraulic motor and winch for the first hoist line and a second hydraulic motor and winch for the second hoist line, and means operable at will, when the first winch motor is operated to draw in the first hoist line, for supplying to the second winch motor a sufficient supply of hydraulic fluid to operate said second winch motor enough to avoid the development of excessive slack in the second hoist line, and means for controlling the pressure of said supply to provide a pressure sufficient to draw in the second hoist line, when slack, but too low to start dumping the clamshell;

said system including a pilot actuated valve controlling a return connection between the discharge side of the first motor, when drawing in its hoist line, and the reservoir; a tandem control valve controlling a connection from said discharge side to the input side of the second motor, and when open supplying fluid for driving the second motor to draw in its hoist line, and a valve controlled in correlation with the last named valve for connecting the pilot port of said pilot actuated valve to be responsive to the input pressure of the first motor when the tandem control valve is closed and to be responsive to the input pressure of the second motor when the tandem control valve is open.

* * * * *